US005231797A

United States Patent [19]

Davis et al.

[11] Patent Number: 5,231,797

[45] Date of Patent: Aug. 3, 1993

[54] PROCESS FOR TREATING MOISTURE LADEN COAL FINES

[75] Inventors: Burl E. Davis, New Kensington; Raymond M. Henry, Gibsonia, both of Pa.; Gordon S. Trivett, South Surrey, Canada; Edgar W. Albaugh, Birmingham, Ala.

[73] Assignee: Energy International Corporation, Pittsburgh, Pa.

[21] Appl. No.: 687,816

[22] Filed: Apr. 19, 1991

[51] Int. Cl.[5] ..... C10L 5/00; C10L 9/00

[52] U.S. Cl. ..... 44/620; 44/626

[58] Field of Search ..... 44/620, 626, 280, 281

[56] References Cited

U.S. PATENT DOCUMENTS 4,402,707 9/1983 Wunderlich ..... 44/620

4,705,533 11/1987 Simmons ..... 44/281

5,035,721 7/1991 Atherton ..... 44/626

FOREIGN PATENT DOCUMENTS 0277018 3/1988 European Pat. Off. .

*Primary Examiner*—Jacqueline V. Howard

*Attorney, Agent, or Firm*—Kirkpatrick & Lockhart

[57] ABSTRACT

A process is provided for making a free flowing granular product from moisture laden caked coal fines, such as wet cake, by mixing a water immiscible substance, such as oil, with the caked coal, preferably under low shear forces for a period of time sufficient to produce a plurality of free flowing granules. Each granule is preferably comprised of a dry appearing admixture of one or more coal particle, 2-50% by weight water and the water immiscible substance.

19 Claims, No Drawings

PROCESS FOR TREATING MOISTURE LADEN COAL FINES

This invention was made with government support under Contract No. DE-AC22-90PC90167 awarded by the Department of Energy. The government has certain rights in this invention.

BACKGROUND OF THE INVENTION

1. Field of the Invention

The present invention relates to processes for the preparation of free flowing granular products from moisture laden caked materials and, more particularly, to a process for making such free flowing granular product by mixing a water immiscible substance with moisture laden coal fines.

2. Description of the Invention Background

Conventional mining and coal preparation operations and advanced coal beneficiation processes required to meet stringent environmental regulations regarding the ash and sulfur content of coal produce finely ground coal and coal fines containing 15 to 40% free moisture. Coal has an inherent or equilibrium moisture content within its structure. Lower ranking coals are known to have higher inherent moisture contents. In addition to coal's inherent moisture, the coal fines produced from conventional mining and coal preparation and coal cleaning processes have a volume of free moisture adsorbed on the surface of the coal particles. The moisture laden fine coal product is generally referred to as wet cake in the coal industry.

Wet cake is essentially a wet, sticky lumped mass of coal particles (generally less than about 28 mesh) which is extremely difficult to store, handle and transport. It is often blended with larger sizes of drier coal for bulk shipment for use as a fuel. However, only wet cake which meets the specific moisture specifications of the blended product can be handled in this way. It is necessary at times, in order to meet those specifications, to dry the wet cake in thermal driers to reduce its moisture content. Drying operations increase the cost associated with the use of such finely ground coals. The excess fine wet coal that cannot be handled in this manner has frequently been discarded in settlement ponds, exposing the operator to economic penalties.

The dust generated from the transport and usage of finely ground dried coal is potentially explosive. Furthermore, the loss during transport represents an economic loss as well as contributing to environmental pollution.

Extensive research has provided means to produce fine coal slurries which are capable of being handled and stored as liquids. These slurries can be spray atomized for combustion in furnaces. However, slurries of this nature require extensive use of costly chemicals to ensure long term storage without settling and for providing viscosity control for pumping and atomization.

Processes in which oil is added to finely ground coal in the preparation of coal-oil suspensions are disclosed in U.S. Pat. Nos. 4,859,209 and 4,744,797. In U.S. Pat. No. 4,744,797 heavy oil and coal powder are mixed under low shear force of about 50–150 revolutions per minute with an aqueous solution of a water-soluble gelatin or glue in heavy oil. The solution of the water-soluble component disperses the water in the heavy oil.

The use of oil to "wet" dried, crushed coal in order to reduce the dustiness and the tendency of such coal to ignite is described in U.S. Pat. Nos. 4,775,390; 4,828,576; 4,783,200; 4,402,707; and 3,953,927.

In coal-oil agglomeration processes, oil is added to dilute coal-water mixtures (less than about twenty percent coal) under high shear forces to coat each particle of coal with the oil. The high shear mixing forces cause the oil-coated coal particles to adhere to each other to form agglomerates having little or no water remaining. Agglomeration processes are used to recover and beneficiate coal from water streams. U.S. Pat. Nos. 4,396,396 and 4,889,538 are representative of coal-oil agglomeration processes.

The developments to date have not, however, provided a practical means for stabilizing wet cake to an easily transportable, storable and handleable material.

There is a need for a process of treating moisture laden caked coal fines, such as wet cake, to provide a free flowing material that is easy to store, transport and use. There is a further need for a process that will eliminate or reduce the hazards associated with the processing and handling of such materials. Finally, there is a need for a process for stabilizing wet cake for use as a fuel.

BRIEF SUMMARY OF THE INVENTION

The present invention provides a process for making a free flowing, easily handleable and storable material. The process comprises mixing caked coal fines having a free moisture content of about 5–60% by weight with an effective amount of a water immiscible substance for a period of time sufficient to produce a plurality of free flowing granules comprised of an admixture of particles of the coal, moisture and the water immiscible substance.

The water immiscible substance may be added to the caked coal fines gradually or all at once during the mixing operation, or may be admixed prior to the mixing step. The process can be run in a continuous or a batch operation.

The caked coal fines may be the material produced during conventional mining, coal preparation or coal cleaning processes and the like, typically referred to as wet cake. The water immiscible substance is preferably an oil which will not evaporate at room temperature. Suitable oils may be chosen from the group consisting of crude oil, lube oil base stocks, diesel fuel, liquid vegetable oils, turpentine, linseed oil, silicones, used lubricating oils, vacuum tower bottoms and No. 6 fuel oil.

The finished product is a dry appearing, granular product having a moisture content of about 2 to 50% by weight. The water immiscible substance is admixed with one or more of the particles forming a granule which is believed to hold the moisture interstitially between the coal particles. The free flowing granules can be handled by conventional methods currently used in dry cement or sand operations. For example, the free flowing granules can be pneumatically transported from storage silos, bins or piles on the ground directly to the site of use. In the preferred embodiment, free flowing granules of the oil, water and coal particle admixture can be transported directly to a combustion chamber capable of burning pulverized coal. The capacity of the moisture to escape the granules enables the free flowing granules to be dried, for example in a thermal drier, if desired. Moisture has not been observed to re-enter the granules following such drying upon exposure to high humidity.

The process of the present invention may include the step of adding a surfactant or some other additive to the free flowing granules, preferably at the site of use, to make a stable coal-water slurry. These additives include surfactants such as the ethylene oxide-propylene oxide block copolymers manufactured by BASF Chemical Corporation (Pluronics) or the alcohol ethoxylates such as those manufactured by the Union Carbide Chemical Corporation (Tergitols). Other agents such as xanthan or guar gum can be used as thickeners for stabilization and viscosity control and lignin or naphthalene sulfonates as dispersants. The slurry can be pumped and/or atomized as desired to the combustion chamber.

The properties of the free flowing granules produced by the process of the present invention can be varied by the selection of the coal type, particle size, choice of water immiscible substances and other interactive parameters known to those skilled in the coal processing art.

The free flowing granules produced by the process of the present invention overcome the handling and transport problems heretofore experienced with caked moisture laden materials, such as wet cake. Further, the product of the present invention significantly reduces the explosion and pollution hazard otherwise associated with conventionally dried fine coal.

DESCRIPTION OF A PREFERRED EMBODIMENT

The process of the present invention can be used to transform moisture laden, caked coal fines into dry appearing free flowing granules which are easy to handle, store, transport and use by conventional methods for handling, storing, transporting and using dry granular materials. For purposes of the detailed description of the invention, the process will be explained with reference to the transformation of wet cake to handleable, free flowing granules, sometimes referred to herein as mulled coal.

The production of the mulled coal according to the process of the present invention begins with the treatment of caked coal fines having a predominant particle size of up to about 28 mesh and a free moisture content of between about 5–60% by weight. The free moisture holds the coal particles together in a plurality of wet, sticky lumps, sometimes referred to herein as wet cake. The wet cake is mixed with a water immiscible substance, preferably an oil and more preferably, a hydrocarbon liquid which will not evaporate at room temperature.

The wet cake and the oil are mixed at room temperature under low shear mixing forces for a period of time, about 5–15 minutes, sufficient to produce a plurality of free flowing granules. Each granule is believed to be comprised of one or more particles of coal having moisture adhering to the surfaces of such particles in admixture with the oil. The granules are believed to hold the water interstitially between the coal particles giving the appearance of a dry, granular product which can contain between about 2–50% moisture with a bulk density of 20–40 lbs/ft$^3$. One possible structure suggested by the behavior and appearance of the granules is the formation of an oil membrane or film which encapsulates the coal particles and adsorbed water.

The low shear mixing forces used in the process are less than the rate of shear which will pull the water from the surface of the coal particles. It has been found that average shear forces up to about one thousand (1000) reciprocal seconds are satisfactory for forming the granules. Shear mixing forces as low as 10–100 reciprocal seconds have also been successfully employed in the laboratory. Higher shear forces are, however, known to work as well. The mixing should not however be so high as to separate the water from the coal, oil mixture. The mixing shear is not thought to be as critical to the process of the present invention as the moisture content of the starting material.

The starting material for the process of the present invention is preferably wet cake formed from the coal fines produced from conventional mining and coal preparation or coal cleaning processes. Higher ranking coals are preferred. Regardless of the inherent moisture content of the caked coal particles, the free moisture content is in the range of about 5–60% by weight, preferably about 10–50% by weight and more preferably, about 20–40% by weight. It has been found that a free moisture content in excess of about 60% by weight will result in the formation of free water mixed in the mulled coal. A free moisture content below about 5–10% is believed to be inadequate for producing the mulled coal by the process of the present invention.

The substance chosen for admixture with the caked coal fines must be immiscible with water. Non toxic, low volatile oils having a high flash point, i.e. at least about 280° F., are preferred. Oils having lower flash points also work well, as shown in Table II herein. Oils which are relatively long chained (N>4) organic or covalent bonded compounds with non-polar chemical functions (hydrocarbons, ethers, silicones, etc.) will suffice. They can, for example, be derived from petroleum (diesel fuel, lube oil stocks, #6 fuel oil, crude oil, reduced crudes, used lube oils and napthas), wood (turpentine), vegetable oils (corn oil, soybean oil, castor oil, linseed oil, etc.) or from synthetic materials (silicones). Highly refined lube oil base stocks, such as those marketed by Chevron and sold as Pale Oil 75 or by Pennzoil as N-60-HT have been successfully employed in the process of the present invention. Typical properties of these oils are set forth below in Table I.

TABLE I

Typical Properties of Additive Oils

| Property | Chevron Pale Oil 75 | Pennzoil N-60-HT |
|---|---|---|
| API Gravity | 26.5 | 26.5–28.0 |
| Viscosity - CST @ 40° C. | 13.3 | 9.07–10.25 |
| Viscosity - SUS @ 100° F. | 75 | 60 |
| Flash Point, COC °F. | 310 | 290 |
| Pour Point, °F. | −20 | −50 |
| Molecular Weight | 300 | — |
| Sulfur, wt. % | 0.09 | <0.50 |

Other oils, however, may be preferred because of economic, environmental or operational considerations. For example, diesel oil has been shown to work well, but poses obvious environmental and safety hazards.

TABLE II

Properties of Representative Additive Oils

| Property | Mineral Spirits | Turpentine | Linseed Oil (raw) |
|---|---|---|---|
| Color | Water-White | Water-White | Yellow-Brown |
| B.P. Range, °F. | 310–377 | 310–330 | None |
| SP. Grav. @ 60° F. | 0.779 | 0.860–0.875 | 0.931–0.936 |
| Flash point, °F. (TCC) | 103° | 90–115° | 432° |

TABLE II-continued

| Properties of Representative Additive Oils | | | |
|---|---|---|---|
| Property | Mineral Spirits | Turpentine | Linseed Oil (raw) |
| Iodine Value | N/A | N/A | 177 |

The quantity of the water immiscible substance used in the process is preferably about 1-5% by weight of the dry coal. Any amount which is effective for transforming the caked coal fines to the oil/water/coal particle admixture which form the dry appearing free flowing granules of the present invention will suffice. The amount of oil used and the size of the individual granules produced by the process of the present invention varies depending upon the initial coal particle size. The coal particle size, in turn, determines the surface area of material and its capacity to retain free moisture. The greater the moisture content of the wet cake, the greater the amount of the water immiscible substance required.

EXAMPLE 1

Four hundred and thirty (430) grams of a wet coal filter cake containing 30% moisture was placed in a laboratory mixer with an open paddle blade. The mixer was turned on at low speed (100-500 revolutions per minute) to ensure mixing. Then nine (9) grams of Pale Oil 75 was added all at one time, and the mixing was continued for 5-10 minutes until a granular free flowing product was obtained. The product flowed freely from the mixing bowl into a container.

EXAMPLE 2

Seventeen thousand four hundred seventy nine (17,479) grams of a wet cake containing 35% moisture (11,361 grams of dry coal plus 6118 grams of water) was placed in a 0.2 cubic meter (six cubic foot) commercial mortar mixer, and slow speed mixing was begun (40-50 revolutions per minute). Then three hundred forty (340) grams (3% based on the dry weight of the coal) of the selected oil was added all at once while continuing mixing. Mixing was continued for 5-10 minutes until the dry appearing granular mulled coal product was formed. The product was then removed by simply dumping the free flowing granules from the movable mixing bowl of the mixer.

EXAMPLE 3

Three hundred (300) grams of a dried Pittsburgh #8 seam coal having a mean volume diameter of 13.3 microns (100% of the particles <62 microns) and containing 6% ash was blended with 190 grams of water. After thorough mixing a wet sticky cake was observed. Then 9.0 grams of Pennzoil HT-60 was added and the mixture stirred in the laboratory mixer at about 200 rpms. A fine dry appearing granular material was observed after about 5-10 minutes. The material could be removed by simply dumping of the mixing container.

EXAMPLE 4

Three hundred (300) grams of a dried Upper Elkhorn #3 coal having a mean volume diameter of 20 microns and containing 1.4% ash was blended with 161 grams of water. After thorough mixing a wet sticky cake was observed. Then 9.0 grams of corn oil (commercial Mazola ® Oil) was added and the mixture stirred in the laboratory mixer at about 200 rpm. A fine dry appearing granular material was observed after 5-10 minutes. The product could be removed by simply dumping the mixing container.

EXAMPLE 5

Three hundred (300) grams of a dried finely ground eastern anthracite coal whose mean volume diameter was 12.7 microns (98% of particles <44 microns) was blended with 161 grams of water. After thorough mixing a wet looking cake was formed. Then 9.0 grams of Pennzoil HT-60 was added and the mixture stirred in the laboratory mixer at about 200 rpm. A dry appearing granular product was obtained after about 5 minutes stirring. The product could be removed by simply dumping the mixing vessel.

The above examples illustrate some features of the process of the present invention. Any suitable mixing device capable of low shear mixing may be used. Commercial scale continuous operations and batch operations may require different types of mixing apparatus.

Studies of the resulting free flowing granules have shown that the mulled coal product loses water very rapidly on exposure to air or heat and that reexposure to high humidity does not result in rehydration. This suggests that the oil may trap or encapsulate the coal particles along with the interstitial water in a manner which readily allows the water to escape but prevents rehydration of the coal particles. This capacity of the granules to lose water renders them susceptible of further processing to reduce the moisture content. The granules may be thermally dried by suitable known means. It should be appreciated, however, that drying is not necessary. The granules produced by the process of the present invention are dry appearing and can be handled, transported and stored in the same manner as any dry granular bulk material. The granules provide a stabilized wet cake that can be combusted without further processing or, readily converted to a coal water fuel at the combustion site.

The process of the present invention is fundamentally different from the oil addition or oil agglomeration processes of the prior art. In the oil agglomeration process, the oil is added to a low concentration (less than 20% coal) coal-water mixture which is then mixed under high shear forces in order to coat each coal particle with oil and cause the particles to adhere to each other to form agglomerates with most or all of the water displaced. In the process of the present invention, the free water is retained. A relatively small amount of a water immiscible substance is added to the moisture laden coal fines under low shear mixing conditions which causes the fine coal particles of water and oil to form a free flowing granular-like admixture in which a plurality of granules comprised of one or more particles of coal and water (2-50% by weight) appear to be trapped or isolated in the admixture with the water immiscible substance.

The free flowing granules are easily removed from the mixing apparatus by suitable known means such as ejection with a plow device or extraction with a vacuum device. Thereafter, the granules can be stored, without the need of preservatives, and easily transferred by conventional means, such as a pneumatic or screw type conveying device, to a combustion chamber such as those used for steam production boilers in electric power plants. The mulled coal can be piled on the ground or stored in known bulk storage systems used for grain, cement or limestone.

The resulting product can alternatively be transferred by conventional carriers of bulk dry granular products to the user's site and mixed prior to use, with additives to transform the free flowing granules to a slurry. Suitable additives can be used to transform the granules into a stable low viscosity coal-water slurry which can be pumped to a spray atomizer for use in combustion processes. These additives include surfactants such as the ethylene oxide-propylene oxide block copolymers manufactured by BASF Chemical Corporation (Pluronics) or the alcohol ethoxylates such as those manufactured by the Union Carbide Chemical Corporation (Tergitols). Other agents such as xanthan or guar gum can be used as thickeners for stabilization and viscosity control and lignin or naphthalene sulfonates as dispersants.

The handling methods that can be employed in connection with the free flowing granules, or mulled coal, of the present invention are not sensitive to moisture levels, feed particle size or variation in coal processing. Loss of moisture during storage has little effect on the handling characteristics.

What we claim is:

1. A process for making free flowing granules comprising:

mixing caked fines of high rank coal having a free moisture content of about 5–60% by weight with an amount of an oil using a mixing force which is effective to produce a plurality of free flowing granules each comprised of an admixture of at least one particle of said coal, moisture and said oil whereby substantially all of said free moisture is incorporated within said granules.

2. The process recited in claim 1 wherein said oil is a liquid hydrocarbon which will not evaporate at room temperature.

3. The process recited in claim 1 wherein the average size of said particles of coal is less than about 28 mesh.

4. The process recited in claim 1 wherein said mixing force is less than about 1000 reciprocal seconds.

5. The process recited in claim 1 wherein said free moisture content of said caked coal fines is between about 20–40% by weight.

6. The process recited in claim 1 wherein said oil is selected from the group consisting of refined lube oil base stocks, diesel fuel, liquid vegetable oils, vacuum tower bottoms, No. 6 fuel oil, silicones turpentine and mineral spirits.

7. The process recited in claim 1 wherein the amount of said oil is an amount up to about 5% by weight of the caked coal fines on a dry weight basis.

8. The process recited in claim 1 further comprising mixing said free flowing granules with an additive selected from the group consisting of surfactants, lignin and napthalene sulfonates and combinations thereof to produce a slurry.

9. The process recited in claim 1 further comprising the step of drying said plurality of free flowing granules to reduce the moisture content thereof.

10. The process recited in claim 1 further comprising the step of mixing said free flowing granules with an additive which is effective for forming a slurry from said free flowing granules.

11. A free flowing material comprising:

a plurality of free flowing granules each said granule being comprised of an admixture of at least one particle of high rank coal, free moisture in the range of about 2–50% by weight, and an oil for holding said free moisture and said at least one coal particle.

12. The free flowing material recited in claim 11 wherein said oil holds said moisture between said particles of coal.

13. The material recited in claim 11 wherein the average size of said particles of coal is less than about 28 mesh.

14. The material recited in claim 11 wherein said oil is a liquid hydrocarbon which will not evaporate at room temperature.

15. The free flowing material recited in claim 10 wherein said free moisture of said granules is in the range of about 10–50% by weight.

16. A process for making free flowing granules comprising:

forming an admixture of caked particles of high rank coal having a free moisture content in the range of about 5% to about 60% by weight and an amount of an oil; and subjecting said admixture to mixing at a mixing force which is effective to produce granules which exhibit no substantial tendency to adhere to one another, each of said granules comprised of at least one particle of said coal with substantially all of said free moisture adsorbed on the surface thereof admixed with said oil liquid.

17. The process recited in claim 16 further comprising drying said granules to reduce the moisture content thereof.

18. The process recited in claim 16 further comprising mixing said free flowing granules with an additive selected from the group consisting of surfactants, lignin and napthalene sulfonates and combinations thereof to produce a slurry.

19. The process recited in claim 16 further comprising the step of mixing said free flowing granules with an additive which is effective for forming a slurry from said free flowing granules.

* * * * *